US011578946B1

(12) United States Patent
Wan

(10) Patent No.: US 11,578,946 B1
(45) Date of Patent: Feb. 14, 2023

(54) MOVABLE POSITION-LIMITING QUICK-RELEASE GUN LIGHT

(71) Applicant: Shenzhen Xinyue Han Technology Co., Ltd., Shenzhen (CN)

(72) Inventor: Xiaobo Wan, Xiangxi Tujia and Miao Autonomous Prefec (CN)

(73) Assignee: Shenzhen Xinyue Han Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/666,682

(22) Filed: Feb. 8, 2022

(30) Foreign Application Priority Data

Jan. 12, 2022 (CN) ..... 202220070501.7

(51) Int. Cl.
*F41G 11/00* (2006.01)
*F41G 1/35* (2006.01)

(52) U.S. Cl.
CPC ..... *F41G 11/003* (2013.01); *F41G 1/35* (2013.01)

(58) Field of Classification Search
CPC ..... F41G 11/003; F41G 1/35
See application file for complete search history.

(56) References Cited

U.S. PATENT DOCUMENTS 2,963,789 A * 12/1960 Wilhelm ..... F41G 1/26 42/137
4,742,636 A * 5/1988 Swan ..... F41G 11/006 42/126
7,185,862 B1 * 3/2007 Yang ..... F16M 11/041 396/428
7,204,052 B2 * 4/2007 Swan ..... F41G 11/003 42/147
8,151,508 B1 * 4/2012 Moore ..... F41G 11/003 42/124
8,151,511 B2 * 4/2012 Gentilini ..... F41G 1/16 42/111
8,438,965 B2 * 5/2013 Collin ..... F41G 11/003 89/125
8,827,219 B2 * 9/2014 Kessler ..... F16M 11/041 396/428
9,217,621 B2 * 12/2015 He ..... F41G 1/387
9,297,616 B2 * 3/2016 Daniel ..... F41G 11/004
9,568,281 B1 * 2/2017 Chen ..... F41A 23/10
9,677,853 B2 * 6/2017 Haugen ..... F41G 11/005
10,030,939 B2 * 7/2018 Kowalczyk, Jr. ..... F41G 1/35
10,036,614 B1 * 7/2018 Ruiz ..... F41G 11/003
10,365,069 B1 * 7/2019 Tayon ..... F41G 11/003
10,443,985 B2 * 10/2019 Cosentino ..... F41G 11/003
10,563,955 B2 * 2/2020 Pniel ..... F41G 1/387
(Continued)

*Primary Examiner* — Michelle Clement
(74) *Attorney, Agent, or Firm* — Georgi Korobanov

(57) ABSTRACT

A movable position-limiting quick-release gun light, comprising a light main body, a bottom end of the light main body is fixedly connected with a support plate, and the left and right sides of which are slidable connected to the top of a base, the middle part of the fixing plate is fixedly connected with a tightening seat, the middle part of the right end of which is fixedly connected to the left end of the tightening rod, and the right end of which is rotatably connected with an tightening handle through a rotating shaft, the front and rear parts of the right end of the tightening seat are fixedly connected to the left end of the ejector rod. The structure of the gun light is simple, the maintenance and disassembly are easy, and the use is very convenient.

8 Claims, 3 Drawing Sheets

(56) References Cited

U.S. PATENT DOCUMENTS

| | | | | |
|---|---|---|---|---|
| 10,684,100 | B2 * | 6/2020 | Pniel | F41G 11/003 |
| 10,801,814 | B2 * | 10/2020 | Ma | F41G 11/003 |
| 10,907,937 | B1 * | 2/2021 | Keng | F41G 11/003 |
| 2011/0042535 | A1 * | 2/2011 | Cheng | F16M 11/043 248/298.1 |
| 2013/0156495 | A1 * | 6/2013 | Li | F16B 2/12 403/322.4 |
| 2014/0093314 | A1 * | 4/2014 | Kessler | F16M 11/041 403/361 |
| 2014/0252187 | A1 * | 9/2014 | Petrovic | F16B 2/185 248/229.16 |
| 2021/0140743 | A1 * | 5/2021 | Chen | F41G 11/003 |
| 2021/0223003 | A1 * | 7/2021 | Morrison | F41G 11/003 |
| 2022/0282956 | A1 * | 9/2022 | Yan | F41G 11/003 |

* cited by examiner

MOVABLE POSITION-LIMITING QUICK-RELEASE GUN LIGHT

CROSS-REFERENCE TO RELATED APPLICATIONS

This application claims the benefit and priority of Chinese patent application No. 202220070501.7, filed on Jan. 12, 2022, disclosure of which is hereby incorporated by reference in its entirety.

TECHNICAL FIELD

The present application relates to the technical field of lighting fixtures, and in particular, to a movable position-limiting quick-release gun light.

BACKGROUND

Lighting fixtures are a general term for lighting tools, which refer to appliances that can transmit light, distribute, and change the light distribution of light sources, including all parts except the light source for fixing and protecting the light source, as well as the wiring accessories necessary for connection with the power supply. Some guns are equipped with gun lights for use.

Gun lights are required to be easy to be assembled and disassembled. The disadvantages of traditional guns are as follows: first, the lights are installed by sliding rails and fixed by friction. During the installation process, the friction is large and not smooth, and there is no locking mechanism after installation, the lighting is easy to slide, and the second is that the position limiting method is to use the sawtooth slide rail to limit the position, which is relatively complicated, not easy to disassemble, high cost, and inconvenient to use.

SUMMARY

The purpose of this application is to propose a movable limit quick release gun light in order to solve the shortcomings in the prior art.

In order to achieve the above object, the application adopts the following technical solutions: A movable position-limiting quick-release gun light comprises a light main body, wherein a support plate is fixedly connected to the bottom end of the light main body, and the left and right sides of the support plate are slidably connected to the top of a base, a fixing plate is fixedly connected to the left side of the bottom end of the base, and the middle part of the fixing plate is fixedly connected to a tightening seat, and baffle plates are fixedly connected to the right side of the bottom end of the base, and the middle part of the right end of the tightening seat is fixedly connected to the left end of the tightening rod, the right end of the tightening rod is rotatably connected with a tightening handle through a rotating shaft, and the front and rear parts of the right end of the tightening seat are fixedly connected to the left end of a ejector rod, ball grooves are evenly distributed in the middle of the top end of the base, two round balls are arranged inside the ball groove, and limiting grooves are evenly distributed at the bottom end of the support plate.

As a further description of the above technical solution: the front end of the light main body is fixedly connected with a light head.

As a further description of the above technical solution: the middle part of the top end of the base is provided with a snap slot, and the left and right ends of the support plate are configured to slidably connect to the snap slot.

As a further description of the above technical solution: the inner side of the baffle plate and the inner side of the fixing plate are provided with chute, the left side of the baffle plate is provided with a stopper spring.

As a further description of the above technical solution: the tightening rod is configured to vertically penetrate the right baffle plate.

As a further description of the above technical solution: the left end of the tightening seat is provided with a tightening nut.

As a further description of the above technical solution: a push rod spring is provided in the outer periphery middle of the ejector rod, and a push rod nut is provided on the left part of the outer periphery of the ejector rod.

As a further description of the above technical solution: a switch button is fixedly connected to the left end of the light main body.

This application has the following beneficial effects:

1. In this application, firstly, when it is necessary to install the light, the tightening handle is pulled outward, and the tightening rod and the tightening seat are in an open state, and then the tightening rod is opened to drive the ejector rod to separate from the corresponding round ball. At this time, the baffle plate is in a loose state, the light main body is relatively easy to slide relative to the gun body, and the base used to fix the support plate and the gun can be flexibly slid to adjust the position. After the adjustment is completed, move the tightening handle inward, the tightening rod drives the tightening seat to move, and the tightening seat pushes the ejector rod against the metal ball to prevent it from rolling, so as to achieve the purpose of locking, and it is very convenient to use.

2. In this application, first, two ball grooves are arranged in the middle of the top of the base, and two round balls are placed in the ball grooves, and then a row of limiting grooves are arranged at the bottom end of the support plate, and the limiting grooves are located directly above the round balls, and the two round balls are located in the corresponding limiting grooves respectively, and finally the round balls will enter different limiting grooves during the rolling process. By arranging the position where the round ball is located in the limiting groove, the purpose of moving and limiting the light main body relative to the base is achieved, the structure is simple, the maintenance and disassembly are convenient, and the use is very convenient.

Figure 1:
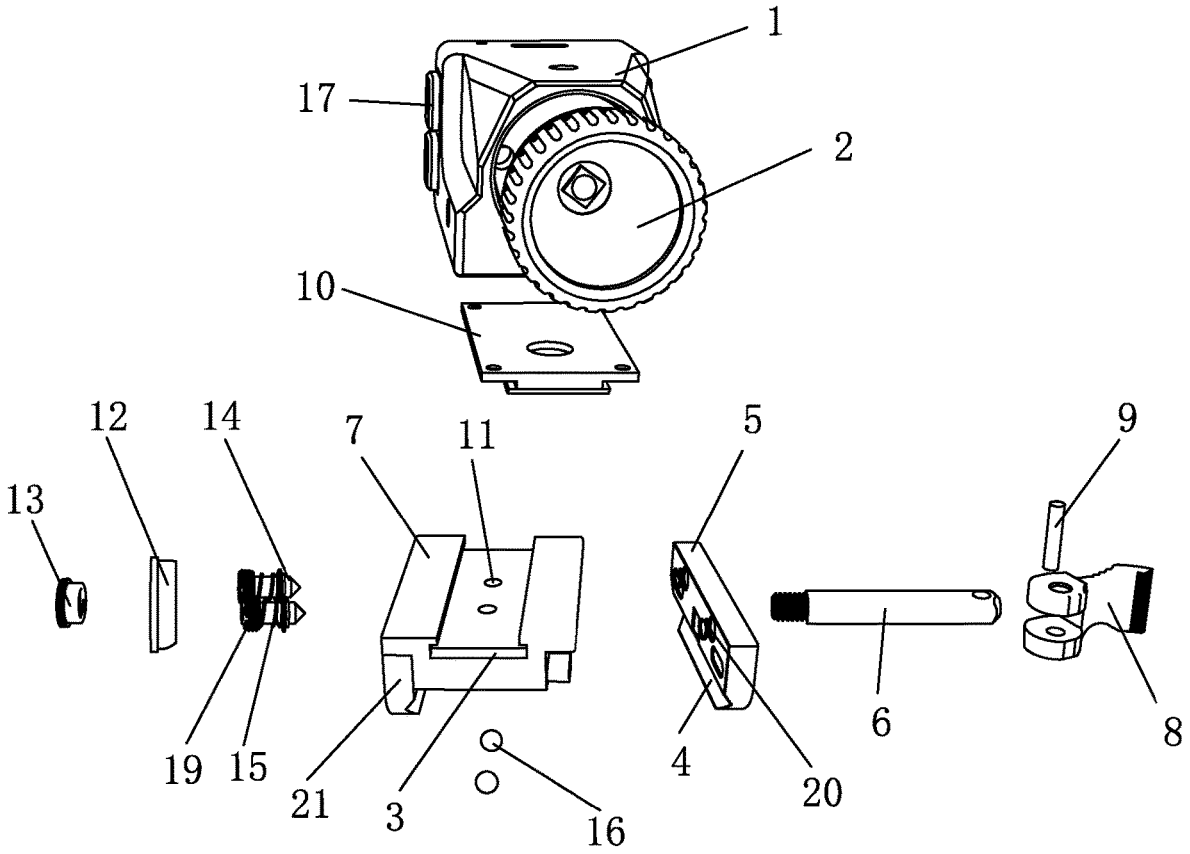
FIG. 1 is a structural perspective diagram of a movable position-limiting quick-release gun light that can be moved according to the present application.

1. Light main body; 2. Light head; 3. Snap slot; 4. Chute; 5. Baffle plate; 6. Tightening rod; 7. Base; 8. Tightening handle; 9. Rotating shaft; 10. Support plate; 11. Ball groove; 12. Tightening seat; 13. Tightening nut; 14. Ejector rod; 15. Push rod spring; 16. Round ball; 17. Switch button; 18. Limiting groove; 19. Push rod nut; 20. Stopper spring; 21. Fixing plate

DETAILED DESCRIPTION

The technical solutions in the embodiments of the present application will be clearly and completely described below with reference to the drawings in the embodiments of the present application. Obviously, the described embodiments are only a part of the embodiments of the present application, rather than all the embodiments. Based on the embodiments in the present application, all other embodiments obtained by those of ordinary skill in the art without creative efforts shall fall within the protection scope of the present application.

In the description of the present application, it should be noted that the terms "center", "upper", "lower", "left", "right", "vertical", "horizontal", "inner", "outer", etc. which are used to indicate position or positional relationship are based on the position or positional relationship shown in the drawings, and are only for the convenience of describing the application and simplifying the description, rather than indicating or implying that the indicated position or element must have a specific orientation and be constructed in a specific orientation and operation, therefore cannot be understood as a limitation of the present application. The terms "first", "second", "third" are used for descriptive purposes only and should not be construed to indicate or imply relative importance. It should be noted that unless otherwise clearly specified and limited, the terms "installation", and "connection" should be understood in a broad sense, for example, it can be a fixed connection or a detachable connection, or integrally connected; it can be a mechanical connection or an electrical connection; it can be directly connected, or indirectly connected through an intermediate medium, and it can be the internal communication between two components. For those skilled in the art, the specific meaning of the above-mentioned terms in the present application can be understood according to the specific circumstances.

Figure 2:
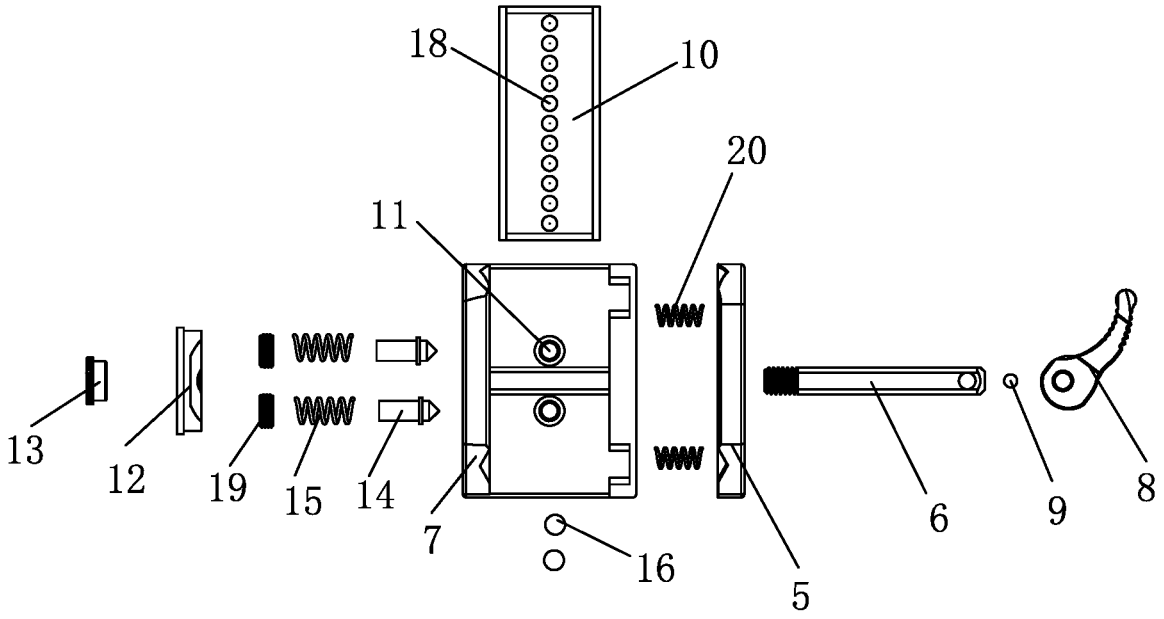
FIG. 2 is an exploded structure diagram of the movable position-limiting quick-release gun light according to the present application.
Figure 3:
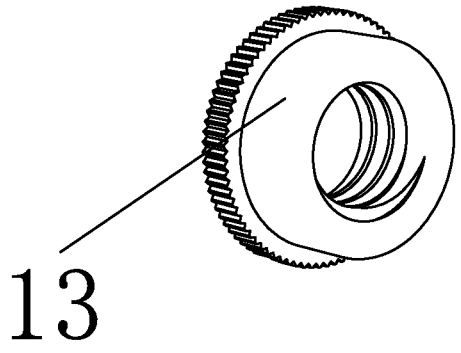
FIG. 3 is a schematic three-dimensional structure diagram of the tightening nut of the movable position-limiting quick-release gun light according to the present application.
Figure 4:
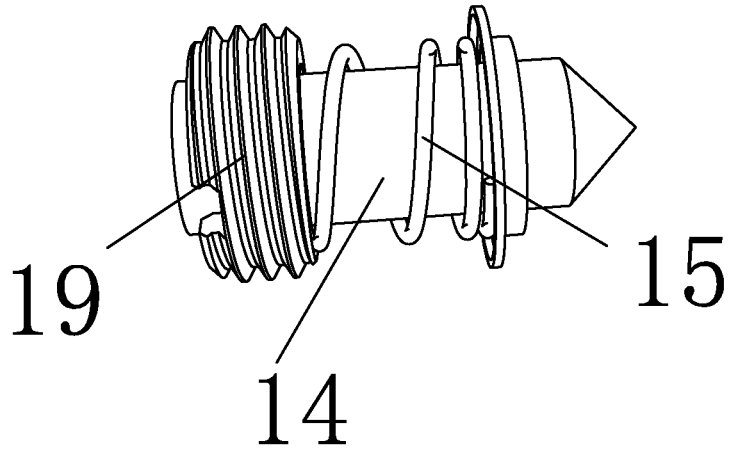
FIG. 4 is a schematic three-dimensional structure diagram of the ejector rod of the movable position-limiting quick-release gun light according to the present application.
Figure 5:
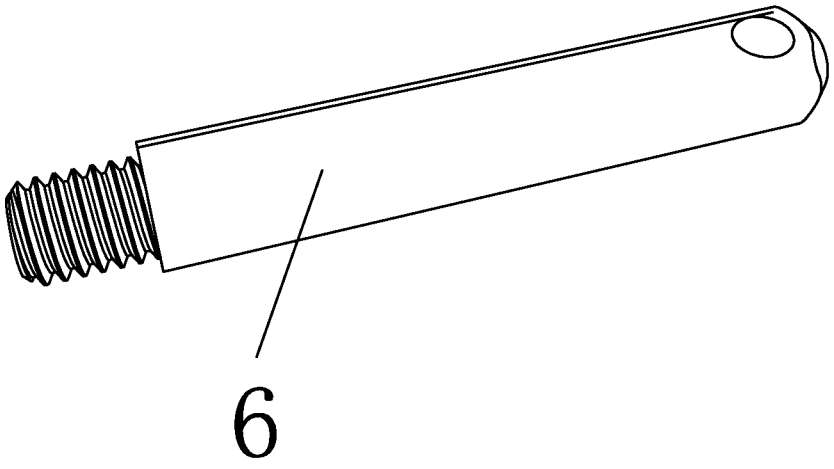
FIG. 5 is a schematic three-dimensional structural diagram of the tightening rod of the movable position-limiting quick-release gun light according to the present application.
Figure 6:
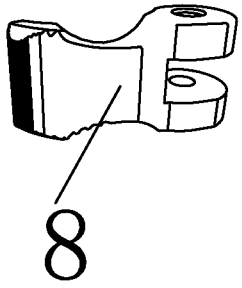
FIG. 6 is a schematic three-dimensional structural diagram of the tightening handle of the movable position-limiting quick-release gun light according to the present application.

Referring to FIGS. 1-6, the movable position-limiting quick-release gun light comprises a light main body 1, wherein a support plate 10 is fixedly connected to the bottom end of the light main body 1, and the left and right sides of the support plate 10 are slidably connected to the top of a base 7, the connection between the light main body 1 and the base 7 is realized through the connection between the support plate 10 and the base 7. A fixing plate 21 is fixedly connected to the left side of the bottom end of the base 7, and the middle part of the fixing plate 21 is fixedly connected to a tightening seat 12, and a baffle plate 5 is fixedly connected to the right side of the bottom end of the base 7, and the middle part of the right end of the tightening seat 12 is fixedly connected to the left end of the tightening rod 6, the right end of the tightening rod 6 is rotatably connected with a tightening handle 8 through a rotating shaft 9, and the front and rear parts of the right end of the tightening seat 12 are fixedly connected to the left end of a ejector rod 14. When it is necessary to install the light, the tightening handle 8 is pulled outward, and the tightening rod 6 and the tightening seat 12 are in an open state, and then the tightening rod 12 is opened to drive the ejector rod 14 to separate from the corresponding round ball 16. The baffle plates 5 on both sides are also in a loose state, and the light main body is relatively easy to slide relative to the gun body, and the base 7 used to fix the support plate 10 and the gun can be flexibly slid to adjust the position. After the adjustment is completed, move the tightening handle 8 inward, the tightening rod 16 drives the tightening seat 12 to move, and the tightening seat 12 pushes the ejector rod 14 against the round ball 16 to prevent it from rolling, so as to achieve the purpose of locking. Ball grooves 11 are evenly distributed in the middle of the top end of the base 7, two round balls 16 are arranged inside the ball grooves 11, and limiting grooves 18 are evenly distributed at the bottom end of the support plate 10. The limiting grooves 18 are located directly above the round balls 16, and the two round balls 16 are located in the corresponding limiting grooves 18 respectively. The round balls 16 will enter different limiting grooves 18 during the rolling process. By arranging the position where the round ball 16 is located in the limiting groove 18, the purpose of moving and limiting the light main body 1 relative to the base 7 is achieved.

The front end of the light main body 1 is fixedly connected with a light head 2. The inside of the light head 2 is provided with a light bulb for lighting. The middle part of the top end of the base 7 is provided with a snap slot 3, and the left and right ends of the support plate 10 are configured to slidably connect to the snap slot 3. The left and right ends of the support plate 10 slide in the snap slot 3, which facilitates the assembly and disassembly of the light main body 1 and the base 7. The inner side of the baffle plate 5 and the inner side of the fixing plate 21 are provided with chute 4, the sliding connection with the gun body is realized through the chute 4. A stopper spring 20 is provided on the left side of the baffle plate 5 and the tightness of the baffle plate 5 is adjusted through the stopper spring 20. The tightening rod 6 is configured to vertically penetrate the right baffle plate 5. The left end of the tightening seat 12 is provided with a tightening nut 13, the function of which is to adjust the tightening rod 6 to achieve an ideal tightening or loosening state. The outer periphery middle of the ejector rod 14 is provided with a push rod spring 15, and the tightening seat 12 generates elastic force by pushing the push rod spring 15 to push the ejector rod 14. A push rod nut 19 is provided on the left part of the outer periphery of the ejector rod 14, and the tightness of the push rod spring 15 is adjusted through the push rod nut 19. The left end of the light main body 1 is fixedly connected with a switch button 17, and the light and dark of the light are controlled by the switch button 17.

Working principle: when it is necessary to install the light, the tightening handle 8 is pulled outward, and the tightening rod 6 and the tightening seat 12 are in an open state, and then the tightening rod 12 is opened to drive the ejector rod 14 to separate from the corresponding round ball 16. The baffle plates 5 on both sides are also in a loose state, and the light main body is relatively easy to slide relative to the gun body, and the base 7 used to fix the support plate 10 and the gun can be flexibly slid to adjust the position. After the adjustment is completed, move the tightening handle 8 inward, the tightening rod 16 drives the tightening seat 12 to move, and the tightening seat 12 pushes the ejector rod 14 against the round ball 16 to prevent it from rolling, so as to achieve the purpose of locking. Ball grooves 11 are evenly distributed in the middle of the top end of the base 7, two round balls 16 are arranged inside the ball grooves 11, and limiting grooves 18 are evenly distributed at the bottom end of the support plate 10. The limiting grooves 18 are located directly above the round balls 16, and the two round balls 16 are located in the corresponding limiting grooves 18 respectively. The round balls 16 will enter different limiting grooves 18 during the rolling process. By arranging the position where the round ball 16 is located in the limiting groove 18, the purpose of moving and limiting the light main body 1 relative to the base 7 is achieved, the structure is simple, the maintenance and disassembly are convenient, and the use is very convenient.

Finally, it should be noted that: the above are only the illustrative embodiments of the present application and are not intended to limit the application. Although the present application has been described in detail with reference to the foregoing embodiments, for those skilled in the art, they can still modify the technical solutions described in the foregoing embodiments, or perform equivalent replacements to some of the technical features. Therefore, any modification, equivalent replacement, improvement, etc., made to the above embodiments based on the actual technology of the present application still fall within the scope of the technical solution of the present application.

What is claimed is:

1. A movable position-limiting quick-release gun light comprising:

a light main body, characterized in that a support plate is fixedly connected to the bottom end of the light main body, and the left and right sides of the support plate are slidably connected to the top of a base, a fixing plate is fixedly connected to the left side of the bottom end of the base, and the middle part of the fixing plate is fixedly connected to a tightening seat, and baffle plates are fixedly connected to the right side of the bottom end of the base, and the middle part of the right end of the tightening seat is fixedly connected to the left end of the tightening rod, the right end of the tightening rod is rotatably connected with a tightening handle through a rotating shaft, and the front and rear parts of the right end of the tightening seat are fixedly connected to the left end of a ejector rod, ball grooves are evenly distributed in the middle of the top end of the base, two round balls are arranged inside the ball grooves, and limiting grooves are evenly distributed at the bottom end of the support plate.

2. The movable position-limiting quick-release gun light as recited in claim 1, wherein the front end of the light main body is fixedly connected with a light head.

3. The movable position-limiting quick-release gun light as recited in claim 1, wherein the middle part of the top end of the base is provided with a snap slot, and the left and right ends of the support plate are configured to slidably connect to the snap slot.

4. The movable position-limiting quick-release gun light as recited in claim 1, wherein the inner side of the baffle plate and the inner side of the fixing plate are provided with chute, the left side of the baffle plate is provided with a stopper spring.

5. The movable position-limiting quick-release gun light as recited in claim 1, wherein the tightening rod is configured to vertically penetrate the right baffle plate.

6. The movable position-limiting quick-release gun light as recited in claim 1, wherein the left end of the tightening seat is provided with a tightening nut.

7. The movable position-limiting quick-release gun light as recited in claim 1, wherein a push rod spring is provided in the outer periphery middle of the ejector rod, and a push rod nut is provided on the left part of the outer periphery of the ejector rod.

8. The movable position-limiting quick-release gun light as recited in claim 1, wherein a switch button is fixedly connected to the left end of the light main body.

* * * * *